US007568583B2

(12) United States Patent
Wing et al.

(10) Patent No.: US 7,568,583 B2
(45) Date of Patent: Aug. 4, 2009

(54) UPRIGHT REAR WALL EXTENSION FOR REFRIGERATOR SHELVES

(75) Inventors: Forrest F. Wing, Des Moines, IA (US); John J. Pink, Cedar Rapids, IA (US); Eric S. Svenby, Sigourney, IA (US); Michael J. Eveland, Cedar Rapids, IA (US); Todd E. Kniffen, Williamsburg, IA (US); Ravi K. Sawhney, Calabasas, CA (US); Timothy Mark Nugent, Venice, CA (US); John Frank Zinni, Capistrano Beach, CA (US)

(73) Assignee: Maytag Corporation, Benton Harbor, MI (US)

( * ) Notice: Subject to any disclaimer, the term of this patent is extended or adjusted under 35 U.S.C. 154(b) by 830 days.

(21) Appl. No.: 10/195,217

(22) Filed: Jul. 15, 2002

(65) Prior Publication Data

US 2003/0019827 A1 Jan. 30, 2003

Related U.S. Application Data

(60) Provisional application No. 60/305,669, filed on Jul. 16, 2001.

(51) Int. Cl.
*A47F 5/08* (2006.01)

(52) U.S. Cl. ..... 211/153; 211/90.01; 211/184

(58) Field of Classification Search ..... 211/153, 211/90.02, 88.01, 90.01, 207, 187, 184, 181.1, 211/13.1, 134, 189, 175, 183; 108/96, 60, 108/61; 312/401, 408, 116, 122, 410
See application file for complete search history.

(56) References Cited

U.S. PATENT DOCUMENTS 965,559 A * 7/1910 Blomskog ..... 126/19 R
3,102,499 A * 9/1963 Shelor ..... 108/28
3,827,574 A * 8/1974 Craig, Sr. ..... 211/184
3,912,085 A 10/1975 Cooke et al.
3,984,163 A * 10/1976 Boorman et al. ..... 312/408
4,437,572 A * 3/1984 Hoffman ..... 211/119.003
4,691,887 A * 9/1987 Bessinger ..... 248/250
4,736,997 A 4/1988 Besore et al.
4,923,260 A 5/1990 Poulsen
5,096,074 A * 3/1992 Merl ..... 211/175
5,148,927 A * 9/1992 Gebka ..... 211/184
5,228,581 A * 7/1993 Palladino et al. ..... 211/153
5,228,764 A * 7/1993 Cherry et al. ..... 312/408
5,314,081 A * 5/1994 Carroll ..... 211/184
5,340,209 A * 8/1994 Kolbe et al. ..... 312/408
5,406,894 A 4/1995 Herrmann et al.

(Continued)

*Primary Examiner*—Jennifer E. Novosad
(74) *Attorney, Agent, or Firm*—Kirk W. Goodwin; McKee, Voorhees & Sease PLC

(57) ABSTRACT

An extending vertical wall secures to the rear edge of a shelf assembly inside a refrigerator compartment. The vertical wall comprises a vertical panel with two downwardly protruding legs. The legs removably reside within sockets included in the rear edge of the refrigerator shelf assembly. When the vertical wall is attached to the refrigerator shelf assembly, the vertical wall prevents items placed on the shelf from toppling off the back edge of the shelf assembly. At the user's discretion, the vertical wall may be quickly and easily removed from the shelf assembly. In an alternative embodiment, the wall is a formed retainer having an inserted U-shape such that the legs are received in the shelf sockets.

6 Claims, 3 Drawing Sheets

U.S. PATENT DOCUMENTS 5,464,103 A * 11/1995 O'Brien ..... 211/133.3
5,486,046 A * 1/1996 Jernstrom et al. ..... 312/408
5,489,031 A * 2/1996 Carroll ..... 211/134
5,516,204 A * 5/1996 Calvert et al. ..... 312/408
5,642,924 A * 7/1997 Wohlrab et al. ..... 312/408
5,685,624 A * 11/1997 Lee ..... 312/405.1
5,735,589 A * 4/1998 Herrmann et al. ..... 312/408
5,769,520 A 6/1998 Jun et al.
5,813,741 A * 9/1998 Fish et al. ..... 312/408
6,138,583 A * 10/2000 Mahone et al. ..... 108/108
6,186,608 B1 * 2/2001 Pink ..... 312/405.1
6,290,077 B2 * 9/2001 Sosso ..... 211/189
6,310,294 B1 * 10/2001 Di Girolamo et al. ..... 174/101
6,648,150 B2 * 11/2003 Hartstone ..... 211/40
6,779,670 B2 * 8/2004 Primiano et al. ..... 211/74
6,962,260 B2 * 11/2005 Jay et al. ..... 211/59.2
7,188,917 B2 * 3/2007 Bienick ..... 312/408
2003/0098635 A1 * 5/2003 Berezovskiy et al. ..... 312/408

* cited by examiner

UPRIGHT REAR WALL EXTENSION FOR REFRIGERATOR SHELVES

CROSS-REFERENCE TO RELATED APPLICATIONS

This application claims priority to the U.S. provisional patent application Ser. No. 60/305,669 entitled "Extending Vertical Wall for Refrigerator Shelves" filed on Jul. 16, 2001.

BACKGROUND OF THE INVENTION

This invention relates generally to refrigerators and, more particularly, relates to an upright rear vertical wall extension for slide out refrigerator shelves, wherein the upright wall extension secures to the rear of a refrigerator shelf to prevent items stored on the refrigerator shelf from falling off the back side of the shelf as the shelf slides.

Typical refrigerator shelves include a glass plate with steel side support plates, overmolded with plastic, such as polypropylene. The molded perimeter shelf edge is a signature feature of the shelf, which may require separate, and costly, shelf molds, or sacrifice distinctiveness.

Refrigerator shelves are known to include an extended rear vertical wall. Such extended vertical walls may be molded or otherwise incorporated into the shelf design. Alternatively, the extended vertical walls may be separate pieces that clip or snap fit to the shelf assemblies.

Molded walls are short in height, due to molding limitations. More particularly, wall height affects manufacturing by complicating the design of the tooling and the process of molding shelves. Design of injection molds anticipates the cooling characteristics (shrink) of the molded part; unanticipated shrink distorts the expected final geometry. Influenced by the non-shrinking glass and the non-shrinking steel components and by their opposing orientations, the front and rear edges shrink differently than the sides of the injection-molded shelf. Consequently, the shrink characteristics of the molded shelf edges are inherently difficult to predict. Increasing the edge (wall) height exacerbates the difficulty of predicting and controlling the shrink (final geometry) of the molded shelf. Greater height affects the shelf cost, adding volume to the molds and adding time and variability to the process.

Another disadvantage of many of the prior art refrigerator shelf assemblies is that the extended vertical wall is not sufficiently tall enough to prevent items placed on the shelf from toppling over the back edge. U.S. Pat. No. 5,769,520 to Jun discloses a refrigerator shelf with a short molded back bracket. This molded back bracket only rises a small distance in height and will not restrain an item placed on the shelf, particularly a larger item, from toppling off the back edge of the shelf. U.S. Pat. No. 5,406,894 to Herrmann discloses an optional rear trim piece that also only rises a fraction of an inch in height and does not prevent items placed on the shelf from toppling off the back edge of the shelf.

Another disadvantage of many of the prior art refrigerator shelf assemblies is that the extended vertical wall is not a separate piece or is integral to the shelf brackets such that the extended vertical wall cannot be removed by the user. The molded back bracket disclosed in Jun primarily serves the function of securing the shelf to the back wall of the refrigerator. This molded back bracket is essential to the structure of the shelf assembly and cannot be removed or separated from the shelf. U.S. Pat. No. 4,923,260 to Poulsen discloses a rear retainer that clips onto the shelf brackets and retains the glass shelf. This rear retainer is integral to the shelf design and cannot be removed from the shelf assembly without compromising the structural integrity of the design. U.S. Pat. No. 3,912,085 to Cooke discloses a retaining clip with a vertical flange. The primary function of the retaining clip is to maintain the shelf in the frame. The retaining clip cannot be removed from the shelf assembly without compromising the structural integrity of the design.

Still another disadvantage of many of the prior art refrigerator shelf assemblies is that the extended vertical wall does not detach easily from the shelf. U.S. Pat. No. 4,736,997 to Besore discloses a reflector that snap fits onto the rear edge of the shelf. This reflector snaps tightly over the rear horizontal support member and cannot be easily removed. Further, because the primary function of this reflector is to hold the components at the rear of the shelf assembly together, the reflector cannot be removed without compromising the structural integrity of the shelf design.

Accordingly, a primary objective of the present invention is the provision of an upright rear wall extension for a slide-out refrigerator shelf that is separate and independent of the shelf and can be quickly and easily installed and removed.

Another objective of the present invention is the provision of an upright rear wall extension for a slide-out refrigerator shelf that is sufficiently tall and strong enough to prevent items placed on the shelf from toppling off the back of the shelf as the shelf slides.

Another objective of the present invention is the provision of an extended upright wall for the rear of a refrigerator shelf wherein the wall is injection molded.

A further objective of the present invention is the provision of an upright rear wall extension for a refrigerator shelf that utilizes a minimum of parts and is easy and inexpensive to manufacture, and durable in use.

These and other objectives will become apparent from the following specification and claims.

SUMMARY OF THE INVENTION

The present invention is directed towards an upright rear wall extension for a slide-out refrigerator shelf. The extension generally comprises a removable wall panel or retainer that secures to the rear edge of a refrigerator shelf assembly. When the user slides the refrigerator shelf forward, the present invention restrains items placed on the shelf from toppling off the back edge of the shelf.

The removable wall extension features a vertical panel portion or retainer sufficiently tall to restrain items placed on the shelf. The removable wall panel or retainer includes two legs that allow the wall panel or retainer to be quickly and easily attached to or detached from the shelf assembly. Sockets are provided in the rear edge of the shelf assembly that mate with and receive the legs on the removable wall panel or retainer.

DETAILED DESCRIPTION OF THE INVENTION

The present invention will be described as it applies to its preferred embodiment. It is not intended that the present invention be limited to the preferred embodiment. It is intended that the invention cover all modifications and alternatives that may be included within the spirit and scope of the invention.

Figure 1:
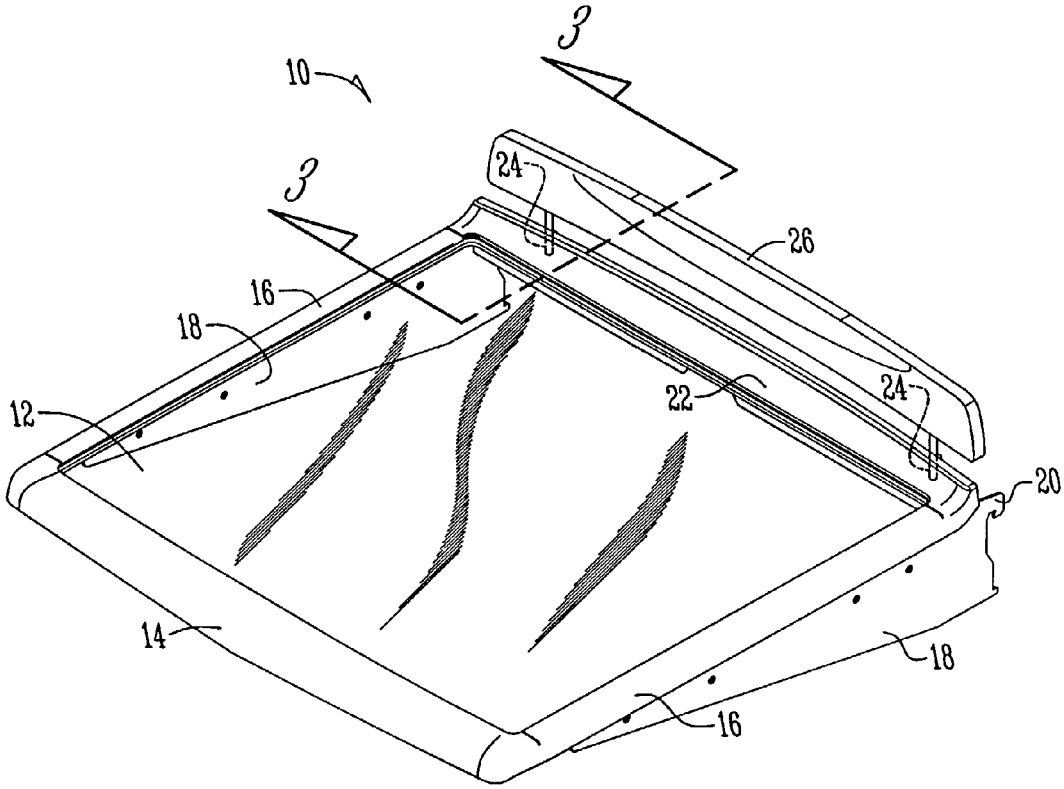
FIG. 1 is a perspective view of a refrigerator shelf having the upright rear wall extension of the present invention.

FIG. 1 illustrates a shelf assembly 10 constructed in accordance with the present invention and of the type used in the main compartment of a refrigerator. The shelf assembly 10 has a clear glass panel 12 that is retained within a rectangular frame 14. The rectangular frame 14 is typically constructed of metal or plastic. The lateral sides 16 of the frame 14 are disposed upon support brackets 18. The brackets 18 have hook-type fasteners 20 at their rear ends for engaging matching recesses in the rear wall of a refrigerator's main compartment. It is noted that the shelf frame 14 and glass panel 12 of the shelf assembly 10 are typically capable of sliding forwardly and rearwardly upon the brackets 18 so that items placed on the glass panel 12 may be more easily accessed. The rear side 22 of the frame 14 has an enlarged ridge.

Figure 3:
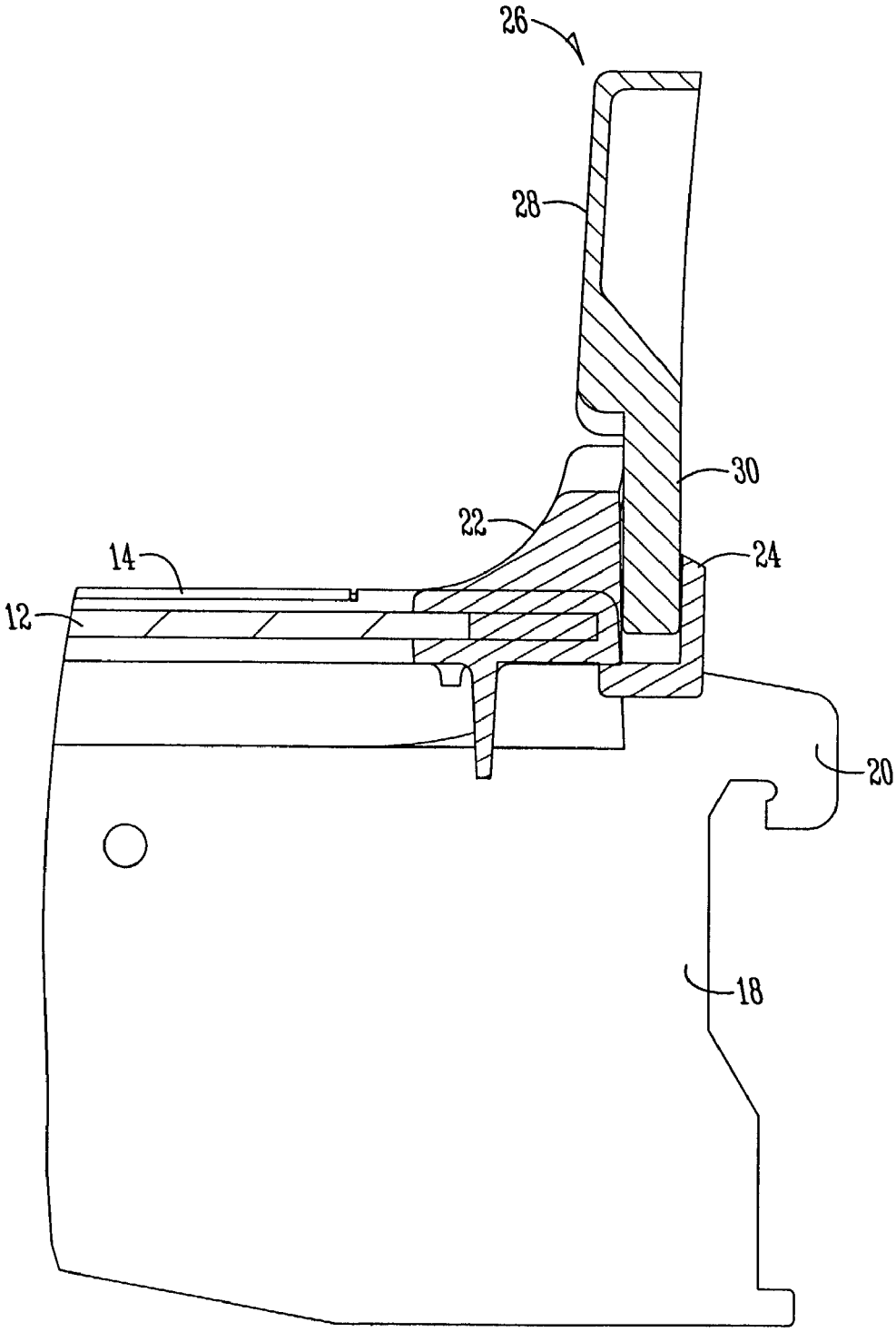
FIG. 3 is a side sectional view taken along lines 3-3 of FIG. 1.

The enlarged ridge of the rear edge 22 is desirable since, when the shelf frame 14 and glass panel 12 are slid forwardly upon the brackets 18, items placed on the glass panel 12 may tend to topple off the back of the shelf assembly 10. The inventors have found, however, that the enlarged ridge of the rear edge 22 may not always be sufficient to prevent items placed upon the glass panel 12 from toppling off the back of the shelf assembly 10. Thus, in accordance with the invention, the rear edge 22 is provided with a pair of sockets 24 toward either lateral end, as best seen in FIGS. 1 and 3.

Figure 2:
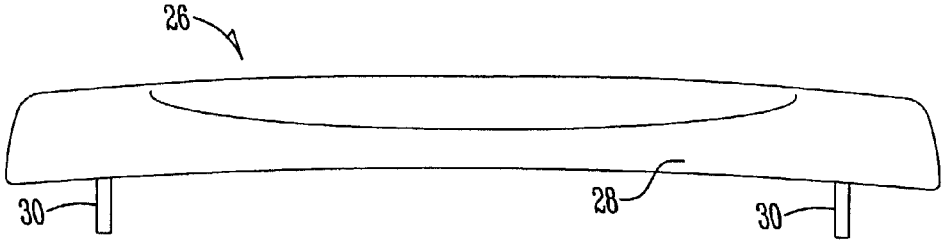
FIG. 2 is a front elevation view of the wall extension.

FIG. 2 illustrates a removable wall extension or member 26. The wall member 26 has a vertical panel portion 28 and two downwardly protruding legs 30. With reference to FIG. 3, the legs 30 are shaped and sized to removably reside within the sockets 24 of the rear edge 22 of the shelf frame 14. When the wall panel 26 is secured to the shelf frame 14, the vertical panel portion 28 extends upwardly a sufficient distance so as to prevent items placed upon the glass panel 12 from falling off the rear portion of the shelf assembly 10 when the shelf frame 14 and glass panel 12 are slid forwardly.

Preferably, the wall member 26 is at least 1½ inches tall, excluding the legs 30. The wall member 26 is typically formed of injection molded plastic separately from other components of the shelf assembly 10. This provides an advantage over a system wherein a rear panel might be formed integrally with the rear of the frame by minimizing or eliminating shrinkage problems during manufacturing, and allows a user to quickly and easily install or remove the wall member 26 as desired.

Figure 4:
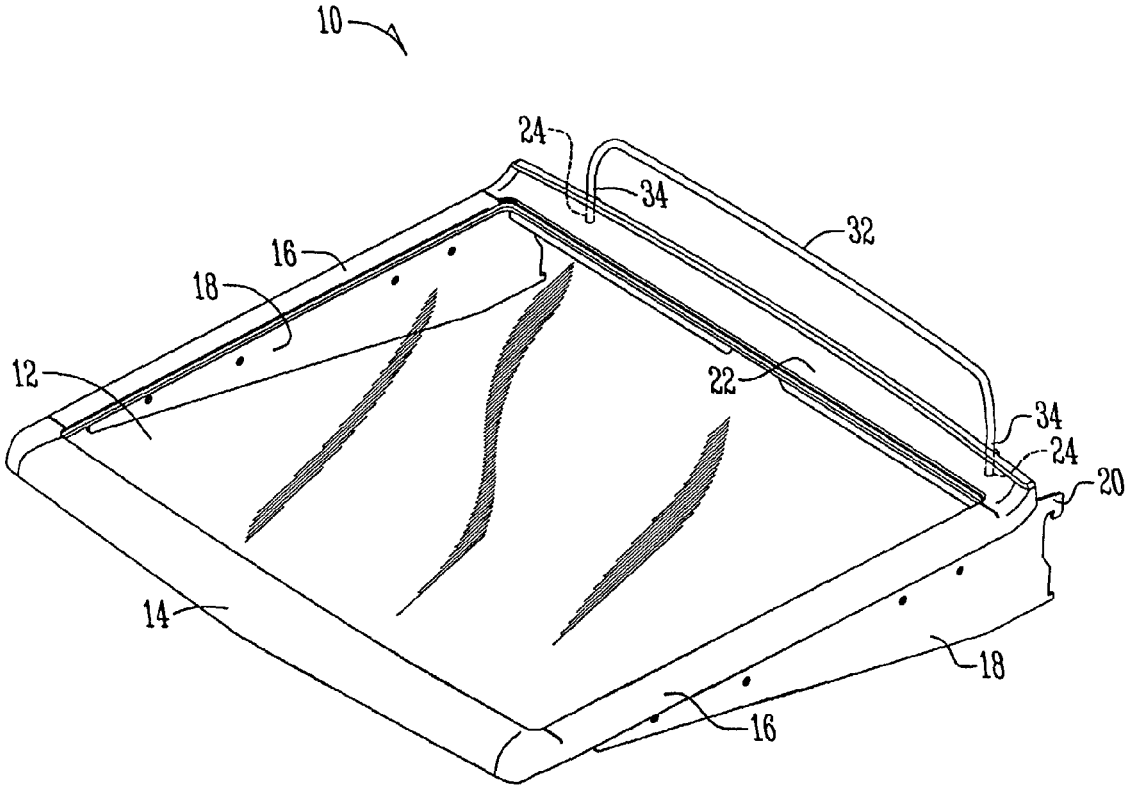
FIG. 4 is a view similar to FIG. 1 showing another embodiment of the invention.

An alternative embodiment of the invention is shown in FIG. 4 wherein a formed retainer 32 includes legs 34 adapted to fit into the sockets 24 of the shelf frame 14. This wire retainer 32 acts as a rear wall member and functions similarly to the wall member 26. Preferably the retainer 32 is made of metal wire, which may be coated with vinyl, plastic or other rust-inhibiting material. The retainer 26 may also be molded plastic.

Whereas the invention has been shown and described in connection with the preferred embodiments thereof, it will be understood that many modifications, substitutions, and additions may be made which are within the intended broad scope of the following claims. From the foregoing, it can be seen that the present invention accomplishes at least all of the stated objectives.

What is claimed is:

1. A refrigerator shelf, comprising:

a horizontal shelf assembly adapted to be mounted within a fresh food compartment of the refrigerator to support food items thereon, and having a front edge, opposite side edges, and a rear edge;

the front edge and opposite side edges being free from upstanding walls so as to define an open shelf front and open shelf sides;

a rear wall extension mounted onto the rear edge of the shelf assembly by moving the rear wall extension downwardly onto the shelf assembly;

wherein the rear wall extension is mounted to the shelf assembly without spring clip action;

wherein the rear wall extension extends above the opposite side edges and front edge of the shelf assembly;

the shelf assembly being non-pivotal in use; and the wall extension being a formed wire.

2. A refrigerator shelf, comprising:

a horizontal shelf assembly adapted to be mounted within a fresh food compartment of the refrigerator to support food items thereon, and having a front edge, opposite side edges, and a rear edge;

the front edge and opposite side edges being free from upstanding walls so as to define an open shelf front and open shelf sides;

a rear wall extension mounted onto the rear edge of the shelf assembly by moving the rear wall extension downwardly onto the shelf assembly;

wherein the rear wall extension is mounted to the shelf assembly without spring clip action;

wherein the rear wall extension extends above the opposite side edges and front edge of the shelf assembly;

the shelf assembly being non-pivotal in use; and the rear edge having an elongated upstanding ridge and the rear wall extension is mounted the ridge.

3. The shelf of claim 2 wherein the ridge has a pair of holes and the rear wall extension has a pair of legs insertable in the holes for mounting the rear wall extension to the ridge.

4. The shelf of claim 3 wherein the holes are spaced inwardly from the side edges of the shelf assembly.

5. The shelf of claim 3 wherein the holes and legs are vertically oriented.

6. The shelf of claim 2 wherein the ridge extends substantially along the width of the shelf assembly between the side edges.

* * * * *